United States Patent [19]

Ozersky et al.

[11] 4,038,349

[45] July 26, 1977

[54] DEVICE FOR REDUCING TOXICITY OF I.C. CARBURETTOR ENGINE UNDER FORCED IDLING CONDITIONS

[76] Inventors: Arkady Solomonovich Ozersky, Festivalnaya ulitsa 31, kv. 139; Vladimir Fedorovich Kamenev, Petrovsko-Razumovsky proezd 15, kv. 85; Boris Alexeevich Kurov, Novo-Konjushenny pereulok, 3, kv. 11, all of, Moscow; Avenir Mikhailovich Gruzdev, ulitsa Michurina, 32, kv. 45; Erlen Manuilovich Rubin, ulitsa Michurina, 32, kv. 22 both of, Zavolzhie Gorkovskoi oblasti, all of U.S.S.R.

[21] Appl. No.: 643,384

[22] Filed: Dec. 22, 1975

[51] Int. Cl.[2] ..... F02M 3/04

[52] U.S. Cl. ..... 261/41 D; 261/DIG. 19; 123/97 B

[58] Field of Search ..... 123/97 B; 261/DIG. 19, 261/41 D

[56] References Cited

U.S. PATENT DOCUMENTS

| | | | |
|---|---|---|---|
| 2,386,340 | 10/1945 | Olson | 123/97 B |
| 2,415,491 | 2/1947 | Hieger | 261/DIG. 19 |
| 2,993,485 | 7/1961 | Cornelius | 123/97 B |
| 3,330,544 | 7/1967 | Ozersky | 261/DIG. 19 |
| 3,752,131 | 8/1973 | Tsumura et al. | 123/97 B |
| 3,866,583 | 2/1975 | Pundt et al. | 123/97 B |

FOREIGN PATENT DOCUMENTS

| | | | |
|---|---|---|---|
| 47-32865 | 10/1964 | Japan | 123/97 B |
| 236,122 | 6/1967 | U.S.S.R. | 123/97 B |

*Primary Examiner*—Tim R. Miles

[57] ABSTRACT

A device for reducing the toxicity of the exhaust of an I.C. carburettor engine under forced idling conditions comprising a pressure regulator incorporating a spring-loaded valve adapted to connect the inlet manifold with the atmosphere via a circular gap, and an idling speed economizer to cut off the supply of fuel through the idling system outlet channels. The valve is installed in the regulator body so that it forms, together with the inner surface of the body, a circular gap in the zone of the valve face. The pressure regulator also has two movable partitions defining variable-volume chambers, a first of which accommodates the valve spring, a second of which is connected to the circular gap, and a third of which is vented to the atmosphere. The first chamber communicates with the carburettor space downstream of the throttle in the zone of the lower edge of the closed throttle at the side opposite to outlet holes of the idling system. The second chamber communicates with the atmosphere through a pressure corrector which controls the pressure in the chamber in accordance with the engine speed.

2 Claims, 1 Drawing Figure

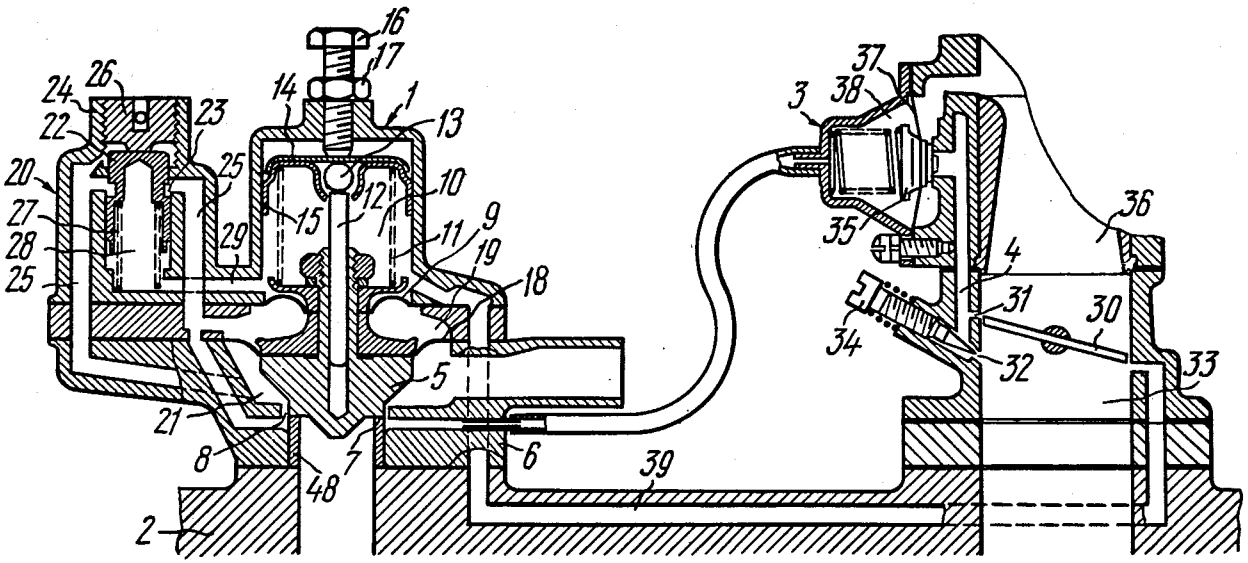
16
17
1
13
14
12
10
11
9
19
18
15
29
25
23
26
24
22
20
27
28
25
5
7
48
8
21
2
6
39
3
38
37
35
34
4
31
32
30
36
33

DEVICE FOR REDUCING TOXICITY OF I.C. CARBURETTOR ENGINE UNDER FORCED IDLING CONDITIONS

The present invention relates to I.C. carburettor engines and more particularly it relates to devices for reducing the toxicity of the exhaust of I.C. carburettor engines under forced idling condition.

The present invention will be most effective when used in vehicles operating in heavy city traffic conditions.

It is a well-known fact that the atmosphere of large cities is polluted mainly by the carburettor engines used in motor vehicles. However, the control of atmospheric pollution from the exhaust gases of vehicles presents an extremely complex problem which so far could not be completely solved. Therefore, the greatest emphasis is laid at present on methods of solving this problem if only partly. Operation of a carburettor engine in city conditions is characterized by a sharp increase in the total idling time, including forced idling and subsequent accelerations of the automobile. Due to frequent engine braking and gearshifting the total duration of forced idling and subsequent accelerations of the automobile amounts nearly to 50% of the total time the automobile is in motion.

Here and herafter the term "forced idling conditions" will be understood to refer to the operation of the engine whose crankshaft rotates at a speed higher than its minimum self-sustaning idling speed with the throttle valve closed.

It is know that the high vacuum arising in the inlet manifold of a carburettor engine under the forced idling conditions greatly affects the toxity index and the other performance factors of this engine; the amount of toxic substances including carcerogenic ones discharged with the exhaust gases increases, which is also intensified by increased penetration of oil from the crank-case into the combustion chambers under the effect of a high vacuum.

thus the forced idling conditions prevailing in heavy city traffic exert a great influence not only on the total discharge of toxic matter, but also on the formation of local zones where concentration of these substances in the air is particularly strong (e.g. road intersections, near traffic lights).

Additionally, intensive penetration of lubricating oil into the combustion chambers from the engine sump during forced idling operation intensifies carbonization, impairs the antiknock qualities, reduces the life of the engine and decreases its reliablity. These detrimental factors are still further aggravated by gradual wear of the piston rings. A considerable reduction in the toxicity of the exhaust of the I.C. carburettor engines can be attained by improving the combustion of the fuel under the forced idling conditions of the engine or by a complete elimination of combustion under these conditions.

In the first instance combustion during the forced idling is improved by increasing the supply of fuel through the carburettor. This, however, unduly increases the fuel consumption and impairs engine braking.

In the second instance combustion is temporarily stopped by cutting off the fuel supply through the carburettor idling system or, simultaneously with the cutting off of the fuel supply, the inlet manifold is put in communication with the atmosphere bypassing the carburettor.

Known in the art is a device which cuts off the fuel supply through the idling system and communicates the inlet manifold with the atmosphere, bypassing the carburettor.

The known device comprises a pressure regulator for putting the engine inlet manifold in communication with the atmosphere under the forced idling conditions, and an idling speed economizer in the form of a spring-loaded valve located in the outlet channel of the carburettor idling conditions. The pressure regulator consists of a spring-loaded valve and two movable partitions, each connected with the valve and the body, said partitions forming variable-volume chambers. The first movable partition is made in the form of a piston capable of moving along the longitudinal axis of the regulator body. The piston limits the first chamber which accommodates the valve spring. The second movable partition is constituted by a membrane which limits the second chamber formed around the piston between the body and the membrane. The second chamber communicates with the gap around the sealing face of the valve. The same membrane, together with the body, forms a third chamber vented to the atmosphere. The valve accommadated in the outlet channel of the carburettor idling system is of the membrane type. Together with the internal surface of the valve body this membrance forms a chamber which communicates with the second chamber of the pressure regulator. The second and third chambers are interconnected by a channel made in the valve. As the carburettor throttle valve closes and the engine is shifted to forced idling, the vaccum in the inlet manifold increases greater than during self-sustaining idling. The same vacuum is built up in the first chamber which accommodates the valve spring because said first chamber communicates with the inlet manifold. The vacuum in the second and third chambers is equal to zero because these chambers are interconnected by a channel and the third chamber is vented to the atmosphere. The valve lifts when the difference of pressures acting on the area which is equal to the difference of areas between the cross section of the valve piston and the area of the circle formed by the sealing face of the valve overrides the valve spring. As a result, the valve opens and a gap is formed between it s face and the seat. The air rushing through this gap creates an ejecting effect which depends on the velocity of the air stream, the latter being governed by the vacuum in the inlet manifold. The ejecting effect of the air stream builds up a vacuum in the second chamber of the pressure regulator, said chamber communicating with the gap around the valve face. The difference of pressures applied to the valve membrane creates an additional force which lifts the valve. As a result, the valve is held open at a vacuum which is lower than required for the initial opening of the valve; this ensures a continuous supply of air into the inlet manifold of the engine and a sharp reduction of vacuum therein within the entire range of speeds at the forced idling duty.

To cut off the regulator when the engine is shifted from forced idling to loaded operation or self-sustained idling it is necessary that the vacuum in the inlet manifold be decreased. This can be achieved by two methods. First, by opening the throttle and thus forcing the valve to close. The vacuum in the inlet manifold will drop and cause a corresponding vacuum drop in the first chamber of the pressure regulator. The vacuum in the second chamber will also drop due to a reduced ejection effect. The valve of the pressure regulator will close after the carburettor throttle is opened and the vacuum in the inlet manifold will be decreased to such an extent the net force of the pressure differentials lifting the valve is to be weaker than the force of its spring.

When the engine is shifted from forced idling to loaded operation and the throttle is slowly opened, a considerable amount of fuel starts flowing through the main metering system of the carburettor with the regulator valve open. The inevitable leaning of the mixture precludes its ignition which increases the discharge of hydrocarbons. Simultaneously, the conditions for smooth transition from forced idling to loaded operation are impaired. Transition of the engine to loaded operation occurs irregularly, with intervals in the increase of the engine torque, and is frequently accompanied by muffler explosions.

The second method is reduction of the crankshaft speed when the engine is shifted to minimum self-sustaining idling speed. The closing of the pressure regulator valve at a certain engine speed required for reliable transition from forced to self-sustaining idling operation depends on the reduction of the vacuum in the seond chamber which is governed by the ejecting effect created by the stream of air through the valve gap. This precludes the possiblity of controlling the moment of valve closing in a number of cases when, for example, it is necessary to eliminate the undue "stalling" of the engine in the course of its transition to the minimum self-sustaining idling speed.

An object of the present invention is to provide a device for reducing the toxicity of the exhaust I.C. carburettor engines under the forced idling conditions which will ensure a bigger reduction in the discharge of toxic agents with the waste gases by timely closing of the pressure regulator valve when the engine is shifted from forced idling to loaded operation.

Another object of the present ivnention resides in obviating the stalling of the engine when it passes from forced idling to self-sustaining idling operation.

Still another object of the invention resides in eliminating interruptions in the transmission of engine torque when the engine passes from the forced idling to loaded operation.

In accordance with these and other objects the essence of the invention lies in providing a device for reducing the toxicity of exhaust of the I.C. carburettor engines under the forced idling conditions, comprising a pressure regulator incorporating a spring-loaded valve for venting the inlet manifold to the atmosphere, installed in the regulator body so that a circular gap is formed. between the valve face and its seat in the regulator body, and two spring-loaded partitions, each connected with the valve and body and forming variable-volume chambers, one of said chambers accommodating the valve spring, the other being located between the movable partitions communicating with the circular gap and the third being vented to the atmosphere, an economizer to cut off the supply of fuel through the outlet channels of the idling system, said economizer communicating with the circular gap wherein, according to the invention, the chamber accommodating the valve spring communicates with the carburettor space after the throttle in the zone of the lower edge of the closed throttle at the side opposite to the outlet channels of the idling system while the chamber located between the movable partitions is vented to the atmosphere through a corrector.

It is practicable that the corrector body have at least one channel for venting the chamber between the movable partitions to the atmosphere, a spring-loaded slide valve installed with provision for axial motion for closing the channel and provided with a circular groove on the outer surface, and a blind chamber accommodating the slide-valve spring and communicating with the first chamber of the pressure regulator.

Such a device is more efficient in reducing the discharge of toxic matter with the exhaust gases by timely closing the regulator valve when the engine passes from forced idling to loaded operation. Timely closing of the regulator valve is achieved by a sharp reduction of vacuum in the first chamber of the pressure regulator which communicates with the carburettor space after the throttle in the zone of the lower edge of the closed throttle. Therefore, at a small opening angle of the throttle the first chamber is already put in communication with the atmosphere. Inasmuch as the first chamber communicates with the corrector blind chamber accommodating the slide valve spring, the vacuum also drops in this chamber. Being acted upon by the spring, the slide valve moves and puts the regulator chamber located between the membranes in communciation with the atmosphere so that the vacuum in this chamber is also reduced. Due to a reduction in the difference of pressures acting on both membranes, the regulator valve will be closed by its spring at a small opening angle of the carburettor throttle. As a result, practically at the beginning of throttle opening there appear conditions for the preparation of fuel mixture of the required composition and for smooth transition of the engine to loaded operation. The regulator valve must close at a certain preset vacuum in the inlet manifold, corresponding to an engine speed which is higher than the minimum self-sustaining idling speed. The changes in this vacuum occurring periodically during operation due to various reasons, e.g. due to a changed setting of the idling system, change the moment of valve closing. If the valve closes at an engine speed which is lower than the preset value, the engine shifting from the forced to self-sustaining idling duty will stall because the idling system will start feeding fuel at a lower crankshaft speed and the time interval required for attaining the minimum idling speed will prove insufficient for the formation in the engine cylinders of the fuel mixture with the required composition. The use of the corrector makes it possible to change the area through the channel which connects the chamber located between the membranes with the atmosphere so that at the moment when the engine running under the forced idling conditions reaches a speed which is somewhat higher than its minimum self-sustaining idling speed, the difference of pressures acting on the slide valve will diminish to such an extent that the slide valve will be moved by its spring to a position in which the vacuum in the second chamber will drop sufficiently to allow the valve to be closed by the force of its spring.

The slide valve of the corrector will occupy a similar position at a small opening of the carburettor throttle when the engine passes over to loaded operation because this small opening angle of the throttle is accompanied by a sharp vacuum drop in the first chamber in the chamber accommodating the spring of the corrector slide valve. As a result, the corrector slide valve will come to a position at which the vacuum in the second chamber will drop sufficiently to allow the valve to be closed by the force of its spring.

The device for reducing the toxicity of the exhaust gases according to the present invention used in automobiles of various classes with carburettor engines ensures a reduction of 25 - 40% and 20 - 50% in the total discharge of carbon dioxide and hydrocarbons, respectively. It has also been observed that the discharge of carcinogenic agents, e.g. 3,4-benzopyrene is reduced several times.

In addition to the above-mentioned hygienic effect, the employment of the device according to the invention under the conditions of city traffic improves the engine performance, namely reduces the consumption of engine oil by 30 - 60%, that of the fuel by 3 - 7%; decreases carbonization; eliminates smoking at the exhaust after engine braking; eliminates the phenomenon of glow ignition.

Other objects and advantages of the present invention will be more apparent from the description of the device that follows with reference to the accompanying drawing, the scale figure of which illustrates a schematic longitudinal section of the device for reducing the toxicity of exhaust of carburettor engines according to the invention.

The device according to the invention comprises a pressure regulator 1(FIG. 1) adapted to connect the inlet manifold 2 of the engines with the atmosphere during the forced idling. operation and an idling speed economizer 3 located on the outlet channel 4 of the carburettor idling system and intended to cut off the supply of fuel through this system. The pressure regulator 1 incorporates a spring-loaded valve 5 installed in the regulator body 6 so as to form with the inner surface of the latter a circular gap 8 in the zone of the sealing face 7 of the valve 5, and two movable partitions in the form of upper and lower membranes 9 and 18, each connected with the valve 5 and regulator body 6 and forming variable-volume chambers. The upper membrane 9 limits the chamber 10 which accommodates the spring 11 of the valve 5 and the rod 12 whose head 13 is articulated in the regulator body 6 by means of two plates 14, 15. The rod 12 is installed in the axial bore of the valve 5. The spring 11 bears at one end of the valve 5 while its other end bears through the plates 14, 15 on an adjusting bolt 16 installed in the regulator 6 and secured on it with a nut 17. The bolt 16 is used for changing the tension of the spring 11 of the valve 5, namely the force pressing the valve 5 against the seat 48 and, consequently, the moment of valve opening.

The lower membrane 18 limits the second chamber 19 which communicates with the circular gap 8 and the atmosphere through a pressure corrector 20 which controls vacuum in the chamber 19 in accordance with the vacuum in the chamber 10.

The third chamber 21 limited by the membrane 18 and the inner surface of the regulator body 6 is vented to the atmosphere. The pressure corrector 20 incorporates a spring-loade slide valve 22 with a circular groove 23 on its outer surface. The corrector body 24 has a channel 25 for connecting the chamber 19 with the chamber 21 and, therefore, with the atmosphere.

The slide 22 is installed with provision for axial movement so that it either closes the channel 25 thereby cutting off the chamber 19 from the atmosphere, or puts it into communication with the atmosphere through the circular groove 23, thus forming a throttle with a variable cross-sectional area. The maximum cross-sectional area is limited by an adjusting plug 26. The spring 27 of the slide valve 22 is located in the blind chamber 28 of the corrector which communicates through a channel 29 with the chamber 40 of the pressure regulator 1.

The carburettor incorporates a throttle 30 for controlling the amount of fuel mixture entering the inlet manifold 2 and holes 31, 32 which connect the outlet channel 4 of the idling system with the carburettor space 33 after the throttle. The discharge of fuel through the hole 32 is controlled by a needle 34.

The idling speed economizer 3 is a membrane-type valve 35 which puts the carburettor space 36 above the throttle in communication with the outlet channel 4 of the idling system. The membrane 37 together with the inner surface of the body of the valve 35 forms a chamber 38 which communicates with the circular gap 8 around the sealing face 7 of the valve 5.

The chamber 10 communicates through the channel 39 with the carburettor space 33 downstream of the throttle in the zone of the lower edge of the closed throttle 30 at the side opposite to the outlet holes 31, 33 of the idling system outlet channel 4.

The device functions as follows.

As the carburettor throttle 30 is closed and the engine passes over to forced idling operation, the vacuum in the inlet manifold 2 is higher than during the self-sustaining idling operation. The same vacuum is created in the first chamber 10 and in the chamber 28 accommodating the spring 27 of the slide valve 22 of the corrector 20. Being acted upon by the increased pressure differential, the slide valve 22 of the corrector 20 compresses its spring 27 and moves to the position in which the second chamber 19 stops communicating with the atmosphere through the circular groove 23 of the slide valve 22 and continues communicating with it only through the circular gap 8 around the valve 5. The regulator valve 5 starts lifting when the difference of pressures acting on the area which is equal to the difference of areas between the effective area of the first membrane 9 and the area of the circle formed by the sealing face 7 of the valve 5 overrides the force of its spring 11. After opening of the valve 5 the circular gap 8 around said valve is put in communication with the gap between the face 7 and seat 48 of the valve 5. The stream of air passing through the circular gap 8 creates an ejecting effect in it, said effect depending on the velocity of air flow which latter is governed by the vacuum in the inlet manifold 2. The ejecting effect of the air flow creates a vacuum in the circular gap 8. The same vacuum is built up in the second chamber 19 of the regulator since it is cut off from the atmosphere by the slide valve 22. The effect of the pressure difference on the second membrane 18 creates an additional force which lifts the valve 5. As a result, the valve 5 is held open when the vacuum in the inlet manifold is lower than required for the initial opening of the valve 5 which ensures uninterrupted supply of air into the engine inlet manifold 2 and a sharp reduction of vacuum in it within the entire range of speeds under the forced idling conditions. The slide valve 22 of the corrector 20 is held in this position after opening of the regulator valve 5 in the high-speed range of the engine when, in spite of a reduced vacuum in the inlet manifold 2 the force of the pressure difference acting on the slide valve 22 of the corrector 20 exceeds the force of its compressed spring 27,.

In this position of the slide valve 22 of the corrector 20 the correcting effect is nonexistent and the vacuum in the second chamber 19 increases to the maximum values which ensure rapid and full lifting of the regulator valve 5 after its initial lifting withthe corresponding reduction of vacuum in the inlet manifold 2.

As the engine speed and the vacuum in its inlet manifold 2 decrease with the corresponding reduction in the difference of pressures acting on the slide valve 22 of the corrector 20, the former is moved by its spring 27 and puts the second chamber 19 in communication with the atmosphere which decreases the vacuum in said chamber. As a result, the valve 5 of the regulator 1 is closed by its spring 11. When the engine speed rises somewhat higher than the speed of self-sustaining idling operation, the slide valve 22 comes to a position in which the vacuum in the second chamber 19 of the regulator drops to such an extent that the force of the spring 11 of the valve 5 exceeds the net force of the pressure difference and the regulator valve 5 closes. This terminal position of the corrector slide valve 22, ensuring smooth transition of the engine from the forced to self-sustaining idling operation is obtained when the slide valve 22 comes to bear against the adjusting plug 26. Thus, by changing the position of the adjusting plug 26 it is possible to adjust the closing moment of the regulator valve 5 in accordance with the minimum speed of the engine at which it does not stall.

When the carburettor throttle 30 is opened and the engine is shifted over to loaded operation, the first regulator chamber 10 and the chamber 28 accommodating the spring of the slide valve 22 of the corrector 20 are put into communication with the carburettor space 36 above the throttle, i.e. with the atmosphere so that the vacuum there drops sharply. Due to the decreased difference of pressures acting on the slide valve 22, the latter is moved by its spring 27 and connectes the second chamber 19 with the atmosphere. Due to a vacuum drop in the first chamber 10 and the second chamber 19 of the regulator, the force of the regulator spring 11 exceeds the net force of the pressure difference and the regulator valve 5 closes at small opening angles of the carburettor throttle 30. This eliminates interruptions in the transmission of engine torgue when the engine is shifted to loaded operation and reduces the discharge of hydrocarbons with the exhaust gases during slow opening of the carburettor throttle 30.

When valve 5 is closed, the idling speed economizer 3 is subjected to atmospheric pressure via gap 8 and the valve 35 is closed so that the supply of fuel is effected through the channel 4 of the idler system. When valve 5 is opened and atmosphereic air streams in through gap 8 to produce vacuum thereat due to ejecting effect, the chamber 38 in economizer 3 is subjected to suction pressure and valve 35 is opened against the action of its biassing spring to provide communication between space 36 and channel 4 to raise the pressure in the channel 4 and halt the flow of fuel mixture through the idler system.

1. Apparatus for reducing the toxicity of the exhaust from I.C. carburetor-fed engines under forced idling conditions, comprising: a carburetor having an idling system including outlet channels; an economizer adapted to cut off the flow of fuel through said channels during deceleration and installed on the carburetor; an inlet manifold and a pressure regulator installed thereon comprising a body mounting a spring-loaded valve adapted to vent said inlet manifold to the atmosphere, said spring-loaded valve being installed in said regulator body so that it forms, together with its inner surface and seat, an adjacent circular gap communicating with said economizer; two movable partitions mounted in said pressure regulator, each connected with said valve and body and forming, together with the inner surface of said body, three consecutively arranged variable-volume chambers, one of which accommodates said valve spring and communicates with the carburetor space downstream of the throttle in the zone of the lower edge of the closed throttle at the side opposite to said outlet channels of the idling system, the second chamber located between said movable partitions communicating with said circular gap and the third communicating with the atmosphere; and a pressure corrector adapted to put said second chamber in communication with the atmosphere and adapted to adjust pressure in said second chamber in accordance with engine speed.

2. A device according to claim 1, wherein the pressure corrector comprises a body with at least one channel putting said second chamber in communication with the atmosphere and having therein a blind chamber communicating with said first chamber of said regulator, and a spring-loaded, axially movable slide valve provided with a circular groove on the outer surface installed in said blind chamber and adapted ot close off said channel.

* * * * *